US005496161A

United States Patent [19]

Machida et al.

[11] Patent Number: 5,496,161

[45] Date of Patent: Mar. 5, 1996

[54] SCROLL FLUID APPARATUS HAVING AN INCLINED WRAP SURFACE

[75] Inventors: Shigeru Machida, Ibaraki; Takashi Saitoh; Susumu Sakamoto, both of Kanagawa, all of Japan

[73] Assignee: Tokico Ltd., Kanagawa, Japan

[21] Appl. No.: 364,111

[22] Filed: Dec. 27, 1994

[30] Foreign Application Priority Data

Dec. 28, 1993 [JP] Japan ..... 5-354645

[51] Int. Cl.[6] ..... F01C 1/04

[52] U.S. Cl. ..... 418/55.2; 418/83

[58] Field of Search ..... 418/55.2, 83

[56] References Cited

U.S. PATENT DOCUMENTS 4,472,120 9/1984 McCullough ..... 418/55.2
4,548,555 10/1985 Hiraga et al. ..... 418/55.2

FOREIGN PATENT DOCUMENTS 58-67902 4/1983 Japan .
58-133491 8/1983 Japan ..... 418/55.2
59-176483 10/1984 Japan ..... 418/55.2
63-306290 12/1988 Japan ..... 418/55.2
5164067 6/1993 Japan ..... 418/55.2

*Primary Examiner*—John J. Vrablik
*Attorney, Agent, or Firm*—Wenderoth, Lind & Ponack

[57] ABSTRACT

The scroll wrap section of an orbitally operating scroll comprises a flat outer circumferential section, a flat inner circumferential section, and a linearly inclined section. During the initial period of compression operation, a very small axial gap is formed between the flat outer circumferential surface of the flat outer circumferential section and the bottom of the other scroll component to allow the air to be reliably contained in the outermost circumferential compression chamber. When the compressor is warmed, the compression heat generated by the air sucked from the suction port causes the inclined section to substantially reduce the axial gap between the inclined section and the bottom of the fixed scroll component and between the inner circumferential flat section and the bottom of the fixed scroll component.

4 Claims, 8 Drawing Sheets

SCROLL FLUID APPARATUS HAVING AN INCLINED WRAP SURFACE

BACKGROUND OF THE INVENTION

The present invention relates to scroll-fluid equipment used for an air compressor, a vacuum pump or the like.

Such equipment is generally known, and has fixed and orbitally operating scroll components, each of which comprises an end plate and a scroll wrap protruding vertically therefrom. The fixed and orbitally operating scroll components are combined so that fluid chambers can be formed between the scroll wraps. The orbitally operating scroll component is revolved relative to the fixed scroll component without rotating itself, causing the fluid chambers to move continuously while their volumes vary.

In the scroll-fluid equipment above, since the fluid chamber moves radially toward the inner section of the scroll wrap while its volume is decreased to compress the fluid, the heat generated due to compression causes the scroll wrap to become hotter in its radially inner section than in its outer section. Thus, if the height of the scroll wrap of one of the scroll components is selected to have an appropriate axial gap between the scroll wrap and the end plate of the other scroll component during assembly, the radially inner section of the scroll wrap has its height increased during operation due to thermal expansion, thereby contacting and galling the end plate of the other scroll component.

A method for allowing the radially inner section of the scroll wrap to have a smaller height than its outer section to address the above problem has been known (for example, Japanese Patent Public Disclosure No. 58-67902). A scroll wrap with too small a height results in too large an axial gap between the scroll wrap and the end plate of the other scroll component, causing the leakage of fluid, while an insufficiently small height of a scroll wrap also may result in galling. No means have been provided to solve these two problems at the same time.

SUMMARY OF THE INVENTION

An object of the invention is to eliminate the foregoing problems. According to the invention, a scroll-fluid equipment comprises a fixed scroll component and an orbitally operating scroll component. Each scroll component has an end plate and a scroll wrap section installed on the end plate to rise therefrom. The scroll wrap of at least one of the scroll components comprises a plurality of zones which define linearly varying axial gaps between the scroll wrap section and the bottom of the other scroll component.

DETAILED DESCRIPTION OF THE INVENTION

Figure 8:
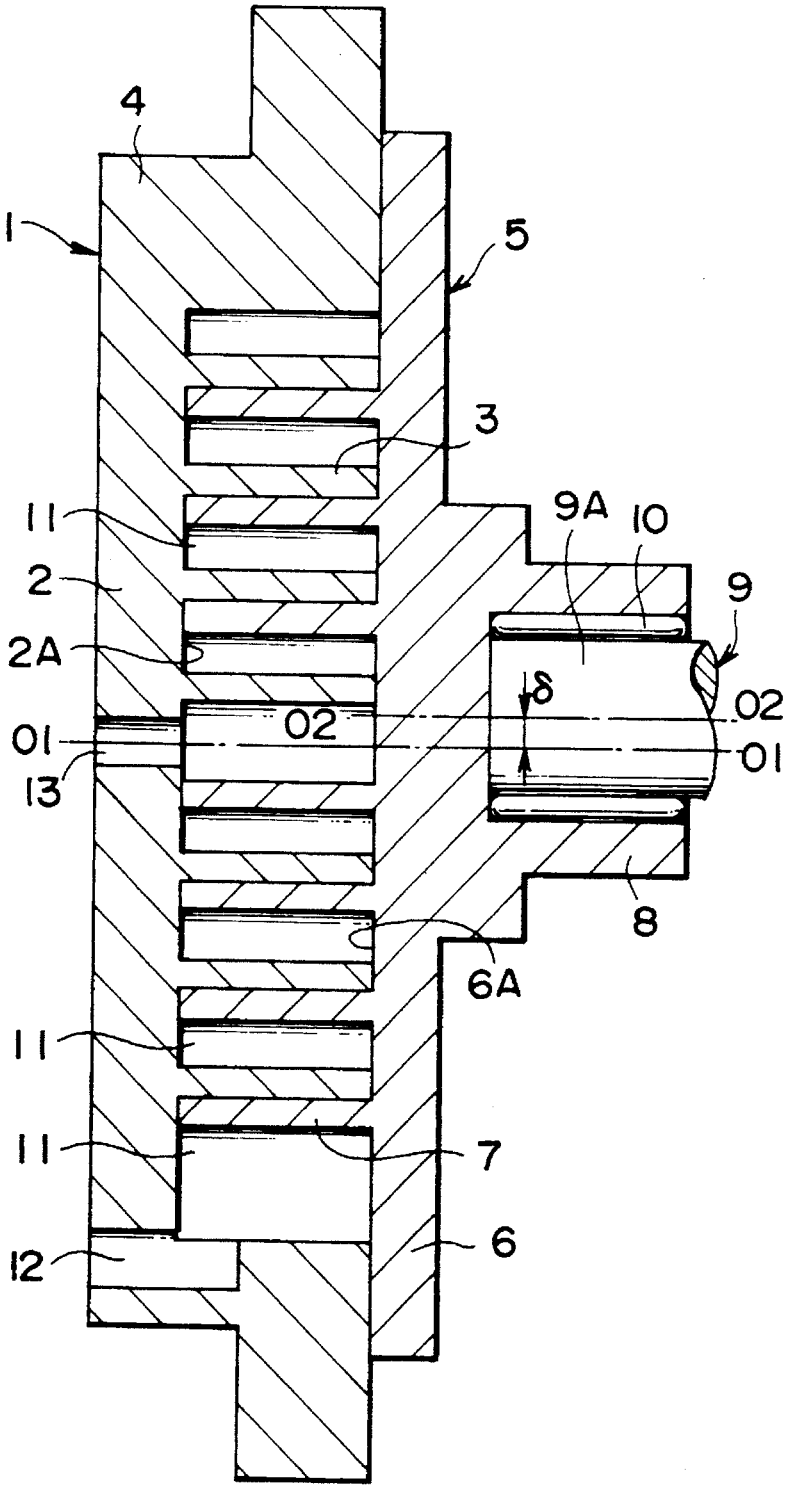
FIG. 8 PRIOR ART
FIG. 8 is a cross-sectional view illustrating the important part of a scroll air compressor in accordance with the prior art.

Before explaining the embodiments of this invention, a scroll air compressor which is a representative example of scroll-fluid equipment in accordance with the prior art is described with reference to FIGS. 8 and 9 to enable the embodiments to be understood more easily.

In the figures, reference numeral 1 designates a fixed scroll component comprising an end plate 2 formed in the shape of a disk, a scroll wrap section 3 formed on the end plate 2 in the shape of a spiral extending from the radially outer side to the center, and a support section 4 located on the outer circumference of the end plate 2 and formed in the shape of a cylinder to surround the scroll wrap section 3, and the surface of the end plate 2 on which the scroll wrap section 3 is installed forms the bottom 2A. The fixed scroll component 1 is attached to a casing via bolts through the support section 4 (the casing and the bolts not shown).

Reference numeral 5 designates an orbitally operating scroll component rotatable and provided within the casing opposite to the fixed scroll component 1 and comprising a disk-like end plate 6, a spiral-like scroll wrap 7 extending vertically from the bottom 6A which is the surface of the end plate 6, similarly to the scroll wrap section 3 of the fixed scroll component 1, and a hub section 8 provided in the middle of the back surface of the end plate 6.

Reference numeral 9 designates a drive shaft rotatable and provided in the casing and a crank section 9A off-centered from the axis 01—01 of the fixed scroll component 1 is provided at the tip of the drive shaft 9. The hub section 8 of the orbitally operating scroll component 5 is rotatable and attached to the crank section 9A of the drive shaft 9 via an orbitally operating bearing 10.

The axis 02—02 of the orbitally operating scroll component 5 is off-centered from the axis 01—01 of the fixed scroll component 1 by a predetermined distance δ, and the scroll wrap section 7 of the orbitally operating scroll 5 component overlaps the scroll wrap section 3 of the fixed scroll component 1 in such a way that these two sections are circumferentially shifted away from each other by a predetermined angle. When the orbitally operating scroll component 5 is revolved relative to the fixed scroll component 1, a plurality of compression chambers 11, 11, . . . , in the shape of crescents which move continuously between the scroll wrap sections 3 and 7 and have their volume reduced are defined.

Reference numeral 12 designates a suction port formed on the fixed scroll component 1 and drilled at the outer circumference of the end plate 2 so that it can communicate with the outermost circumferential compression chamber 11.

Reference numeral 13 is a discharge port drilled in the center of the end plate 2 of the fixed scroll component 1 so that it can communicate with the innermost circumferential compression chamber 11.

Scroll air compressors in accordance with the prior art have the above configuration. The operation of these scroll air compressors is described below.

When the drive shaft 9 is rotated by a motor (not shown), this rotation is transmitted from the crank section 9A of the drive shaft 9 to the orbitally operating scroll component 5 via the orbitally operating bearing 10 to revolve the orbitally operating scroll component 5 around the axis 01—01 of the fixed scroll component 1 with an orbital operating radius of a predetermined distance δ. A device for allowing this orbital operation while maintaining the orientation of the scroll component 5 (not shown) is provided. This orbital operation causes the compression chambers 11, 11, . . . , defined between the scroll wrap sections 3 and 7 to be continuously contracted to sequentially compress the air sucked from the suction port 12 into each compression chamber 11 while discharging the compressed air from the discharge port 13 toward an external air tank (not shown).

In the above scroll air compressor in accordance with the prior art, the compression of a gas generates heat within each compression chamber 11 defined between the fixed scroll component 1 and the orbitally operating scroll component 5, thereby making each of the scroll components 1 and 5 very hot. Since the pressure in each compression chamber 11 sequentially increases from the radially outermost compression chamber 11 to the central compression chamber 11, the temperature gradient extends from the outermost circumference to the center in each of the scroll wrap sections 3 and 7.

That is, the central (radially innermost) compression chamber 11 becomes hotter than the radially outermost compression chamber 11, and the temperature of the gas with an increased pressure in the center of each of the scroll components 1 and 5 may increase up close to 300° C. when the discharge pressure, for example, reaches a rated operation value of 0.83 Mpa. This increase in temperature causes each of the scroll wrap sections 3 and 7 to thermally expand, and the scroll wrap sections located at the center that become particularly hot expands notably. During the thermal expansion of each of the scroll wrap sections 3 and 7, the axial gap between the top surface of each of the scroll wrap sections 3 and 7 and the bottoms 2A and 6A of the end plates 2 and 6 become smaller than that just after assembly, causing the top surface of each of the scroll wrap sections 3 and 7 to contact the bottoms 2A and 6A of the end plates 2 and 6. When the pressure of the contact surface further increases, galling occurs and the end plate 2 or 6 or the scroll wrap section 3 or 7 may be damaged, reducing the compression efficiency and durability of the compressor.

To solve these problems, in the scroll-fluid equipment described in Japanese Patent Public Disclosure No. 58-67902 referenced above, the height from the top surface of the scroll wrap section of the orbitally operating or fixed scroll component to the bottom of the other scroll component is adjusted so that, after assembly, the largest axial gap is formed at the innermost portion of the scroll wrap section between the top surface of each of the scroll wrap sections and the bottom of the other scroll component.

However, this conventional technique fails to specify a method for setting a desired gap at the top of the scroll wrap section. If this technique is applied, for example, to an oil-free air compressor, compressed air may leak through an axial gap during the initial operation of the air compressor or the compressor may take extra time to reach its rated operation.

The inventor thus, for example, embedded a temperature sensor in the top surface of each of the scroll wrap sections 3 and 7 to measure the temperature distribution thereof during a compression operation. The results of this experiment show that the distribution of the temperature of the top of each of the scroll wrap sections 3 and 7 was constant for the first turn at the outermost portion and the fourth turn at the innermost portion and varied to form a curve for the second and third turns as shown in FIG. 9.

Figure 9:
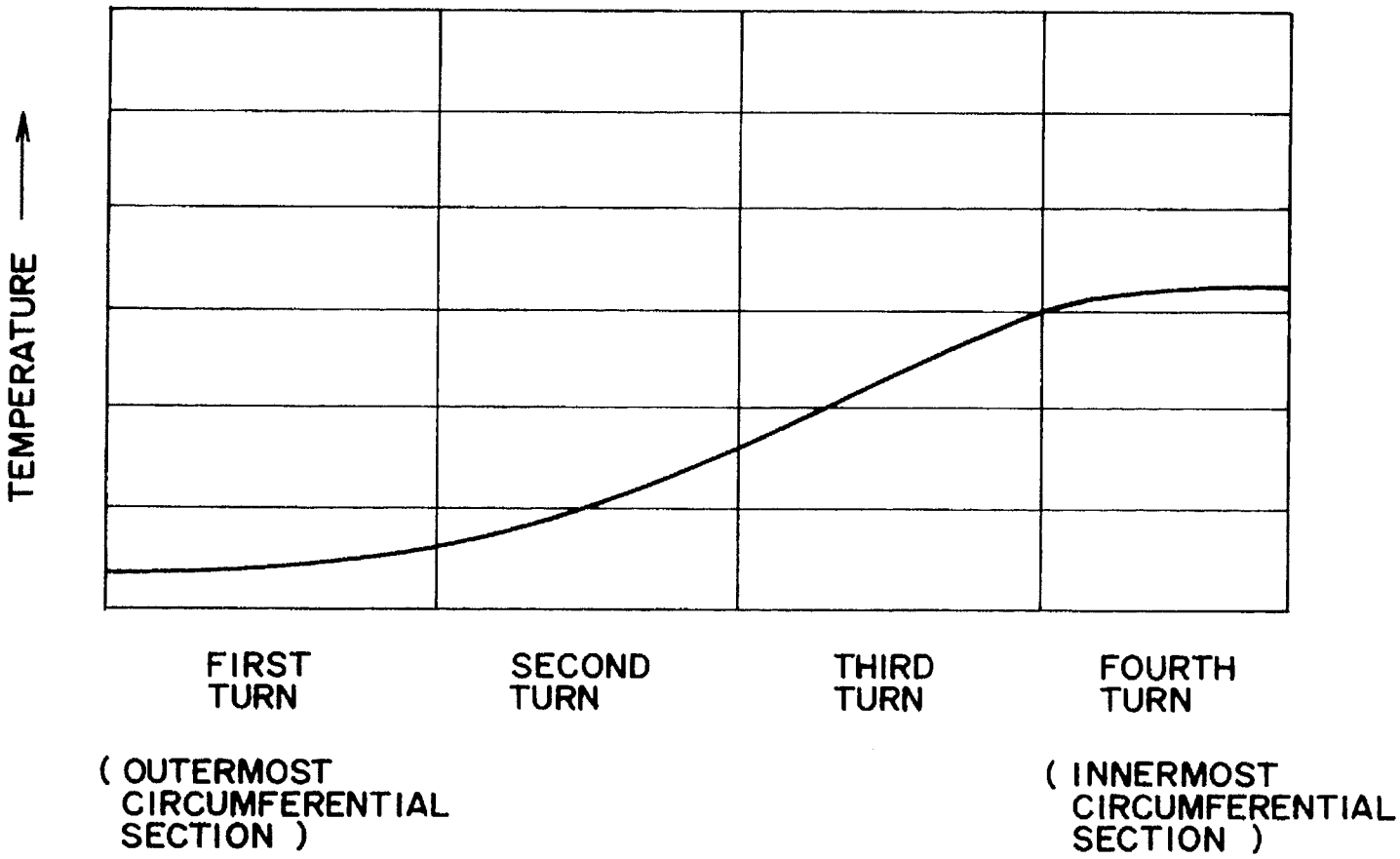
FIG. 9 is a characteristic diagram illustrating the temperature distribution of the wrap section of a scroll air compressor.

It is very difficult, however, to machine the scroll wrap section in such a way that the top surface of the scroll wrap section forms a curve to provide for thermal expansion based on the temperature distribution in FIG. 9, and this process is expensive.

Embodiments of this invention are described below with reference to FIGS. 1 to 7. In the embodiments, the corresponding components carry the same reference numerals as in the prior art and therefore their description is omitted.

Figure 1:
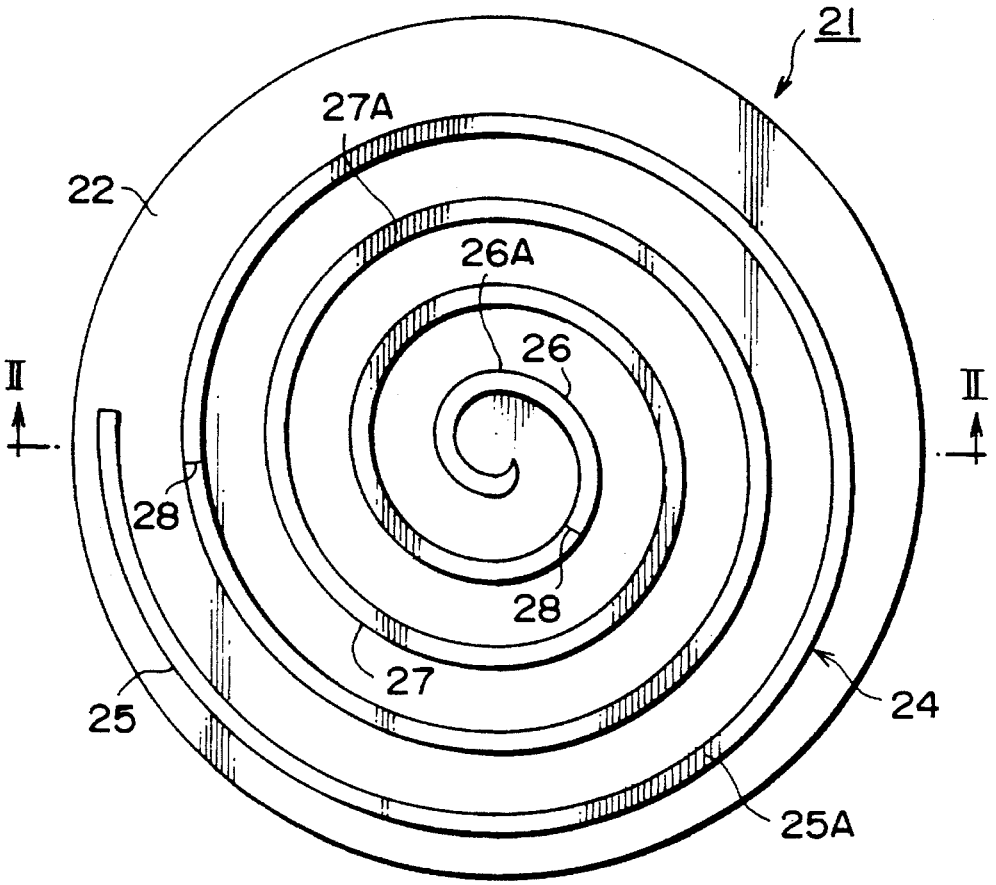
FIG. 1 is the front view of an orbitally operating scroll component used in the first embodiment of this invention.
Figure 2:
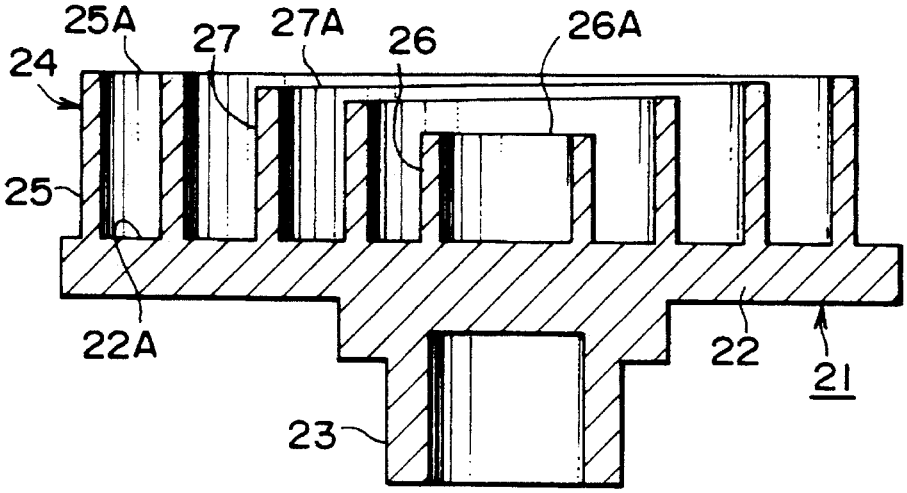
FIG. 2 is a cross-sectional view taken in the direction of arrow II—II shown in FIG. 1.
Figure 3:
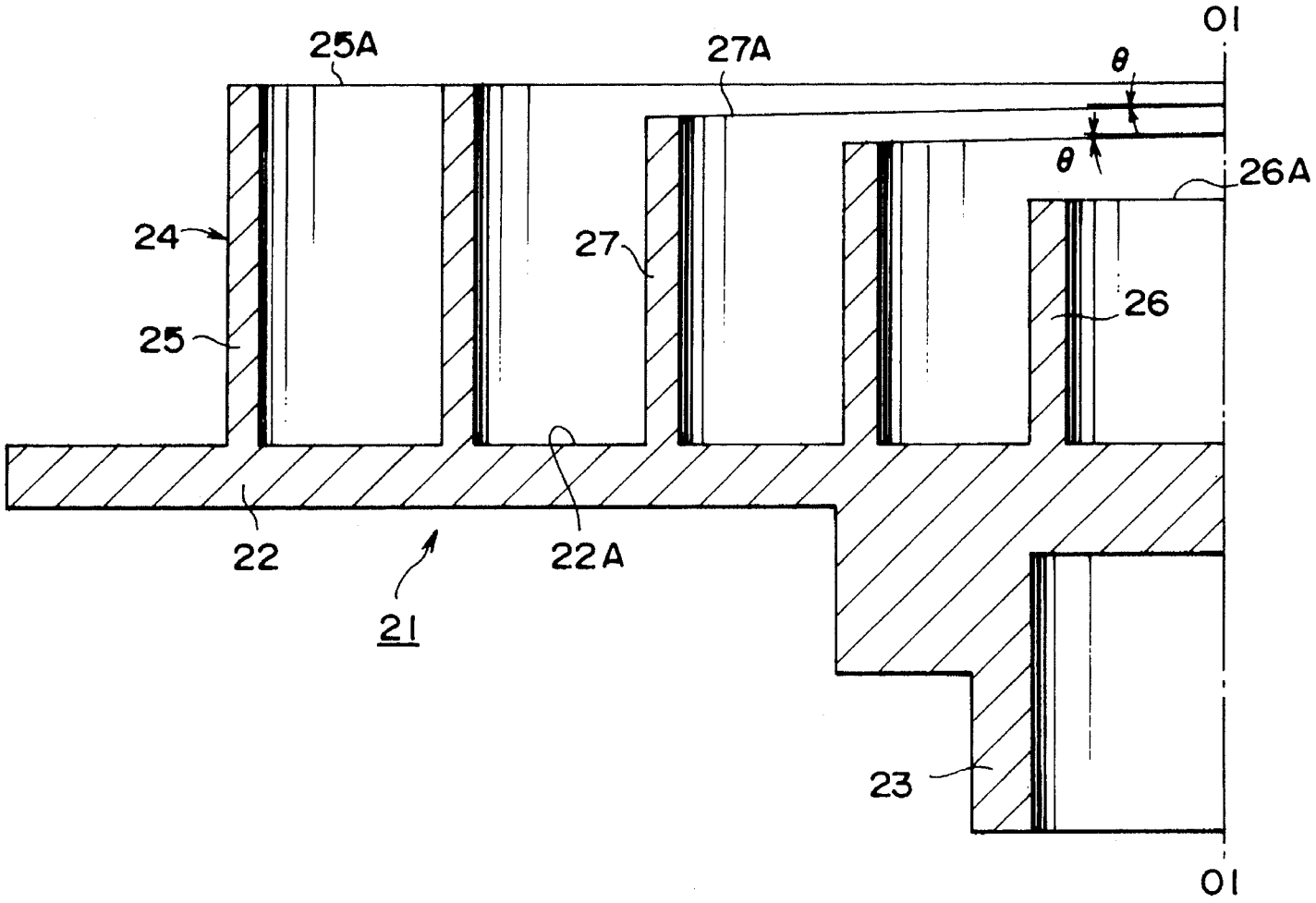
FIG. 3 is an enlarged view of the important part of the orbitally operating scroll component shown in FIG. 2.

FIGS. 1 to 3 show the first embodiment of this invention.

In the figures, reference numeral 21 designates an orbitally operating scroll component (or orbital scroll component) in accordance with this invention which is combined with a fixed scroll component 1 and is used instead of the orbitally operating scroll 5 described in the prior art. In the same way as the orbitally operating scroll component 5 described in the prior art, the orbitally operating scroll component 21 generally comprises an end plate 22, a hub section 23, and a scroll wrap section 24. However, the orbitally operating scroll component 21 differs from the orbitally operating scroll component 5 in that the scroll wrap section 24 is profiled and comprises a flat (or constant-height) outer circumferential section 25, a flat (or constant-height) inner circumferential section 26, and an inclined section 27 described below. In the following description, the shape of the scroll component is described when the atmosphere has an ordinary temperature (about 20° C.).

Reference numeral 25 designates the flat outer circumferential section that corresponds to the first turn at the outermost portion of the scroll wrap section 24 and has the greatest height from the bottom 22A of the end plate 22 to the top surface that forms a flat outer circumferential surface 25A parallel to the end plate. When the orbitally operating scroll component 21 is combined with the fixed scroll component (not shown), the outermost circumferential compression chamber is formed with the smallest axial gap remaining between the flat outer circumferential surface 25A and the bottom of the fixed scroll component.

Reference numeral 26 designates a flat inner circumferential section that corresponds to one turn or one and a half turns at the innermost portion of the scroll wrap section 24 and has the smallest height. The top surface of the flat inner circumferential section 26 comprises a flat inner circumferential surface 26A parallel to the end plate as shown in FIGS. 2 and 3 and also forms the largest gap between itself and the bottom of the other scroll component.

Reference numeral 27 designates an inclined section located between the flat outer circumferential section 25 and the flat inner circumferential section 26 and formed to have a constant inclination Θ with respect to the flat outer circumferential section 25 and the flat inner circumferential section 26, the height from the bottom 22A of the end plate 22 to the top surface of the scroll wrap section 24 decreasing linearly in the direction toward the flat inner circumferential surface 26A. The top surface of the inclined section 27 comprises an inclined surface 27A, and the axial gap between the top surface and the bottom of the other scroll component gradually increases with the inclination Θ between the flat outer circumferential surface 25A and the flat inner circumferential surface 26A. Boundary lines 28 that exhibit the discontinuity of height are formed between the inclined surface 27A and the flat outer circumferential section 25A and between the inclined surface and the flat inner circumferential surface 26A. When the orbitally operating scroll component 21 is combined with the fixed scroll component, the axial gap between the scroll wrap section 24 of the orbitally operating scroll component 21 and the bottom of the other scroll component varies at three sites: the flat outer circumferential section 25, the flat inner circumferential section 26, and the inclined section 27. The outermost circumferential compression chamber is formed with the smallest axial gap remaining between the flat outer circumferential surface 25A and the bottom of the fixed scroll component.

The scroll air compressor in accordance with this invention has the above configuration. The operation of this air compressor is described below.

During an initial compression operation, the scroll wrap section 24 of the orbitally operating scroll component 21 and the scroll wrap section of the fixed scroll component are at ordinary temperature. Since the flat outer circumferential surface 25A, that is, the top surface of the flat outer circumferential section 25 is opposed at a very small axial gap to the bottom of the other scroll component, there is no leakage to the suction port and the air can be reliably contained in the outermost circumferential compression chamber.

The compressor is then warmed up. When the compressor reaches its rated state, the air sucked from the suction port moves continuously from the outermost circumferential compression chamber to the center while having its volume reduced. Heat is generated at this point, and the first to fourth turns of the scroll wrap section 24 are heated to the temperatures shown in FIG. 9. The inclined section 27 of the scroll wrap section 24 expands thermally in such a manner that the magnitude of thermal expansion gradually increases toward the inner portion and that the flat inner circumferential section 26 is subjected to the largest thermal expansion. This causes the axial gap between the inclined section 27 and the bottom of the fixed scroll component and between the flat inner circumferential section 26 and the bottom of the fixed scroll component to decrease substantially, allowing the air to be reliably contained in each compression chamber formed between the inclined section 27 and the fixed scroll component and effectively preventing the gas compressed in these compression chambers from leaking, thereby improving the compression efficiency of the compressor.

In addition, since the compression chamber when it is at the innermost portion communicates with the discharge port, the pressure of the compression chamber does not increase substantially even if the orbitally operating scroll 21 revolves in a high rate, and therefore, substantially no compressed gas leaks from the flat inner circumferential surface 26A to a radially outer compression chamber. This allows the use of a large axial gap and thus freer design.

Provision of the flat inner circumferential surface 26A thus prevents galling caused by an increase in frictional force between the scroll wrap section 24 and the bottom of the fixed scroll component and their sliding movement, and enables the scroll wrap section to be easily machined.

Consequently, according to this invention, once heat is generated in each compression chamber due to a compression operation and the temperature of the orbitally operating scroll component 21 and the fixed scroll component reaches a predetermined value, an appropriate axial gap can be maintained between the inclined section 27 of the scroll wrap section 24 and the bottom of the fixed scroll component and between the flat inner circumferential section 26 and the bottom of the fixed scroll component. This improves compression efficiency, and reliably prevents the scroll wrap section 24 from contacting, wearing, or galling the bottom of the fixed scroll component due to thermal expansion during the rated operation of the compressor, thereby simplifying the machining of the scroll wrap section 24 and reducing manufacturing costs.

Figure 4:
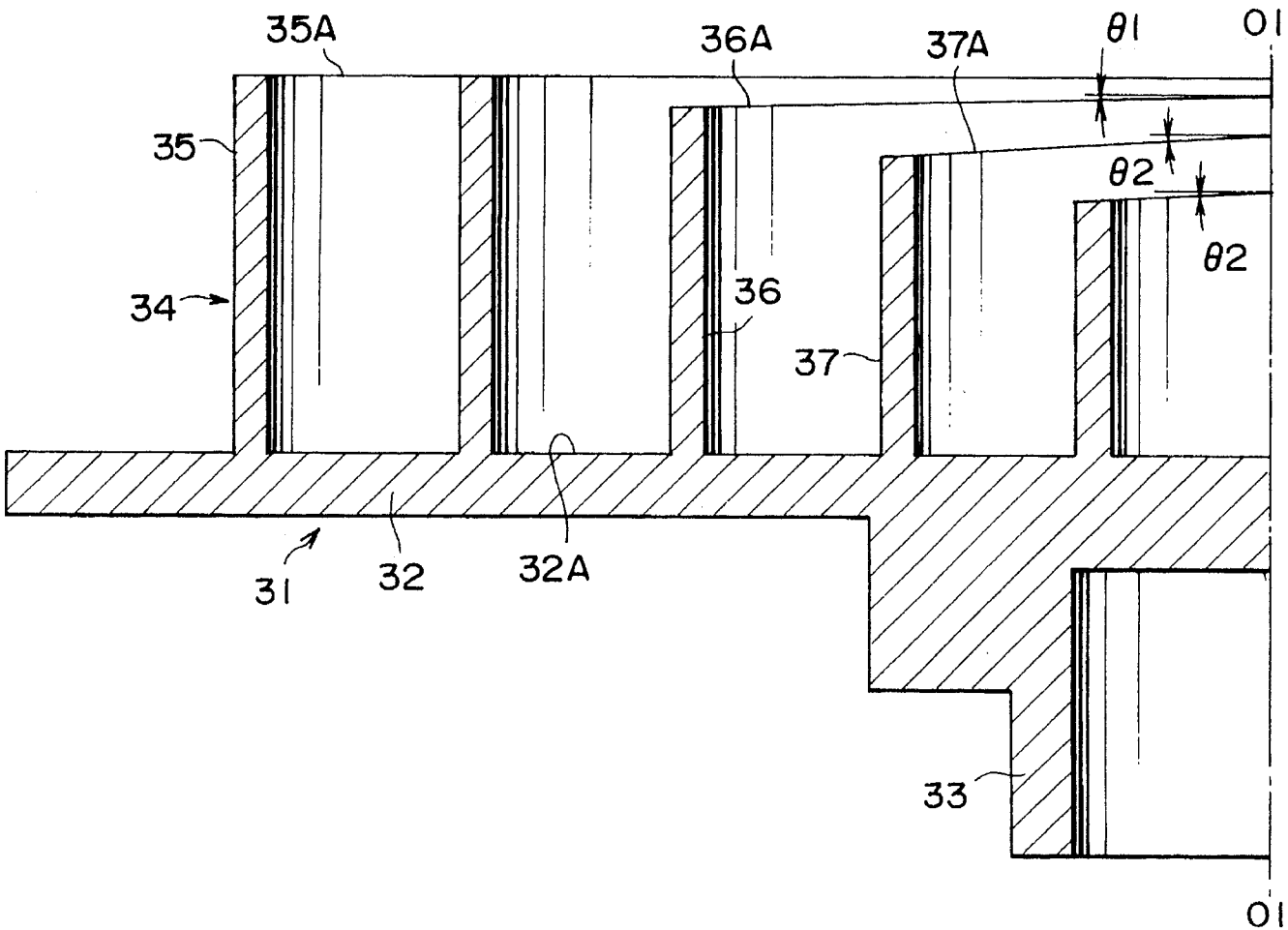
FIG. 4 is an enlarged cross-sectional view of the important part of an orbitally operating scroll component used in the second embodiment of this invention.
Figure 5:
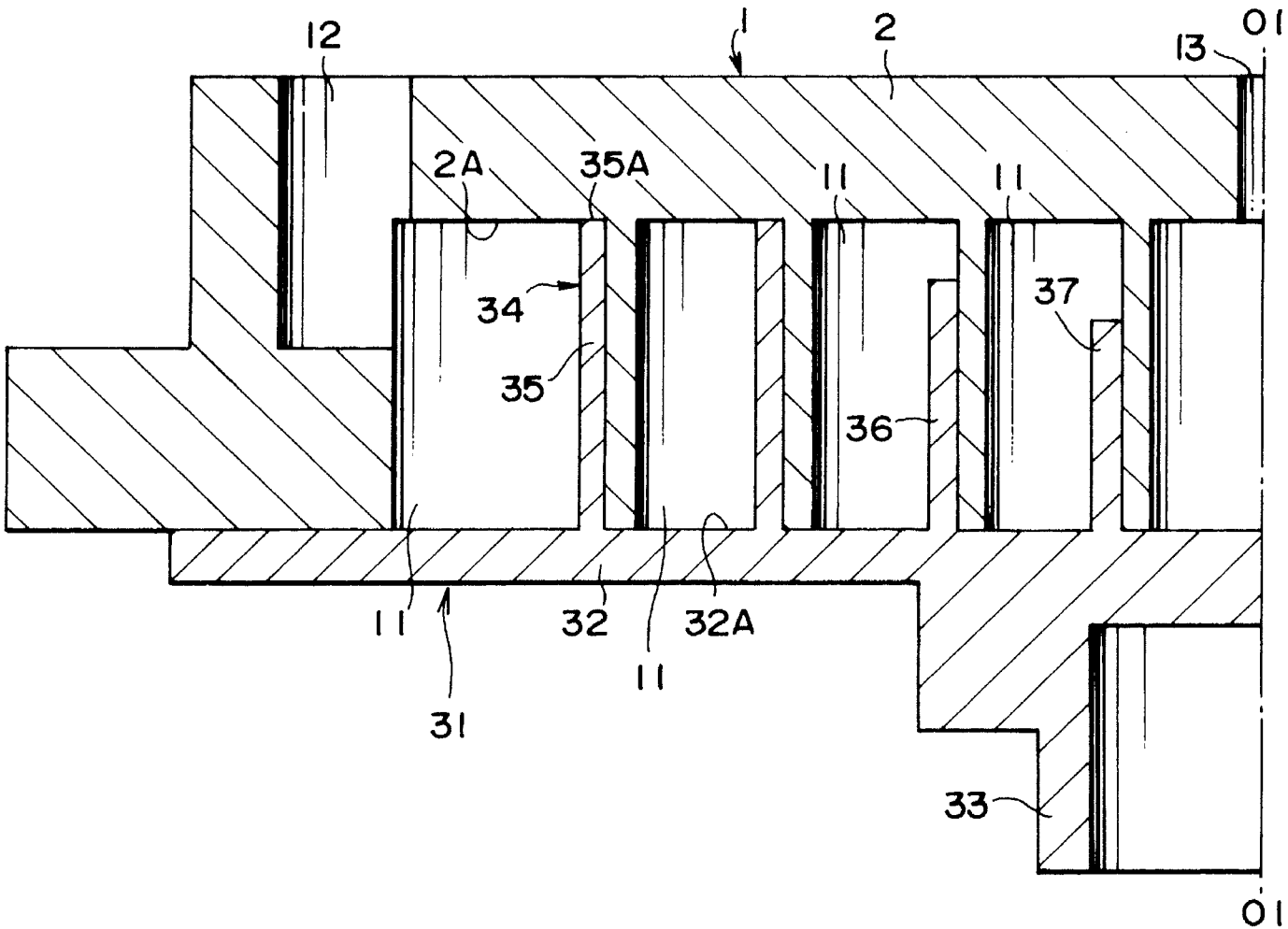
FIG. 5 is an enlarged view of the important part of the orbitally operating scroll component in FIG. 4 and the fixed scroll component combined therewith.

FIGS. 4 and 5 show a second embodiment of this invention. This embodiment is characterized in that the fixed scroll component has the same shape as that in the prior art and that the outermost circumferential turn of the scroll wrap section of the orbitally operating scroll component forms a flat outer circumferential surface with the greatest height and that a first and a second inclined surfaces are formed between the flat outer circumferential surface and the innermost circumferential section so that the height of the scroll wrap section decreases at two levels. In this embodiment, the corresponding components carry the same reference numerals as in the first embodiment and their description is therefore omitted.

In the figures, reference numeral 31 designates an orbitally operating scroll component used for the scroll air compressor of this embodiment. Like the orbitally operating scroll component 21 described in the first embodiment, the orbitally operating scroll component 31 generally comprises an end plate 32, a hub section 33, and a scroll wrap section 34 described below. However, the scroll wrap section 34 of this orbitally operating scroll component 31 comprises a flat outer circumferential section 35, a first inclined section 36, and a second inclined section 37 described below. In this embodiment, the shape of the orbitally operating scroll 31 is shown in a state just after assembly (that is, at an ordinary temperature).

Reference numeral 35 designates a flat outer circumferential section that substantially corresponds to the first turn of the scroll wrap section 34 and has the greatest height from bottom 32A of the end plate 32 to the top surface which forms a flat outer circumferential surface 35A, as in the flat outer circumferential section 25 described in the first embodiment. When the orbitally operating scroll component 31 is combined with the fixed scroll component 1 as shown in FIG. 5, the outermost circumferential compression chamber 11 is formed with the smallest axial gap remaining between the flat outer circumferential surface 35A and the bottom 2A of the fixed scroll component 1.

Reference numeral 36 designates a first inclined section that joins with the inner circumferential end of the flat outer circumferential section 35 of the scroll wrap section 34 and the top surface of which comprises a first linearly inclined surface 36A. The first inclined section 36 is formed as one turn or one and a half turns so that a constant inclination $\Theta 1$ is formed between the first inclined surface 36A and the flat outer circumferential surface 35A, the height from the bottom 32A of the end plate 32 to the second inclined surface 37A decreasing linearly.

Reference numeral 37 designates a second inclined section that joins with the inner circumferential end of the first inclined section 36 of the scroll wrap section 34 and the top surface of which comprises a second flat inclined surface 37A. The second inclined section 37 is formed as one turn or one and a half turns so that a constant inclination $\Theta 2$ ($\Theta 2 > \Theta 1$) is formed between the second inclined surface 37A and the flat outer circumferential surface 35A, the height from bottom 32A of the end plate 32 to the second inclined surface 37A decreasing linearly.

With the above configuration, this embodiment has approximately the same effects and advantages as the first embodiment, and, in particular, enables the scroll wrap section 34 to be machined easily by using the second inclined section 37 to form the innermost circumferential compression chamber 11 wherein the pressure of the gas does not increase despite a high rate of rotation of the orbitally operating scroll component 31.

Figure 6:
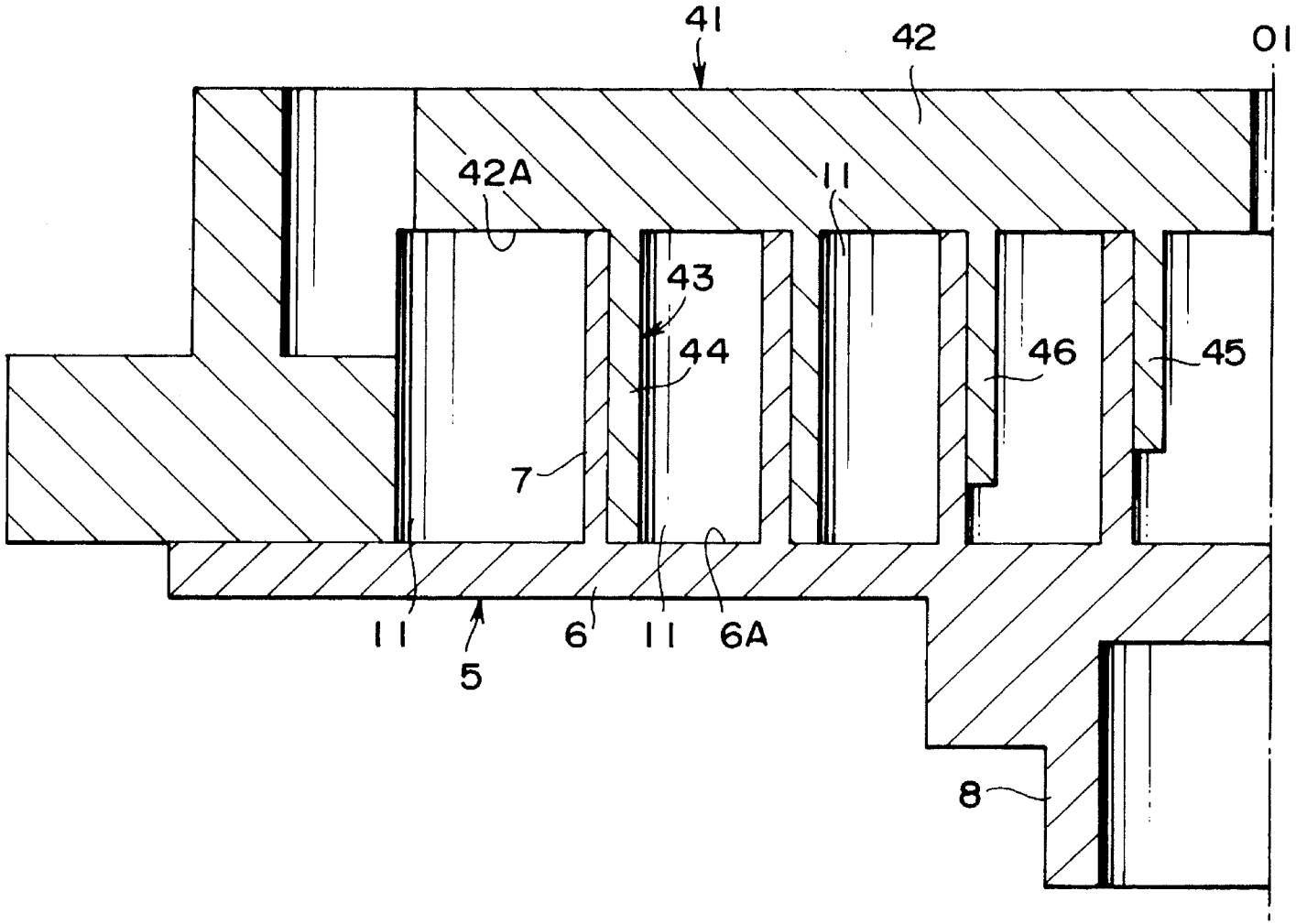
FIG. 6 is an enlarged cross-sectional view of the important part similar to FIG. 5 illustrating a variation of the embodiment of this invention.

Although, in the above embodiments, the scroll wrap section 24 (34) of the orbitally operating scroll component 21 (31) comprises the flat outer circumferential section 25 (35), the flat inner circumferential section 26, and the inclined section 27 (36, 37), this invention is not limited to this feature, and variation is allowed as shown in FIG. 6; a fixed scroll component 41 may comprise an end plate 42, a wrap section 43 consisting of a flat outer circumferential section 44 and a flat inner circumferential section 45, and an inclined section 46 formed so that the height from the bottom 42A of the end plate 42 to the top surface decreases with a constant inclination between the flat outer circumferential section 44 and the flat inner circumferential section 45, and the fixed scroll component 41 may be combined with the orbitally operating scroll component 5 described in the prior art.

Figure 7:
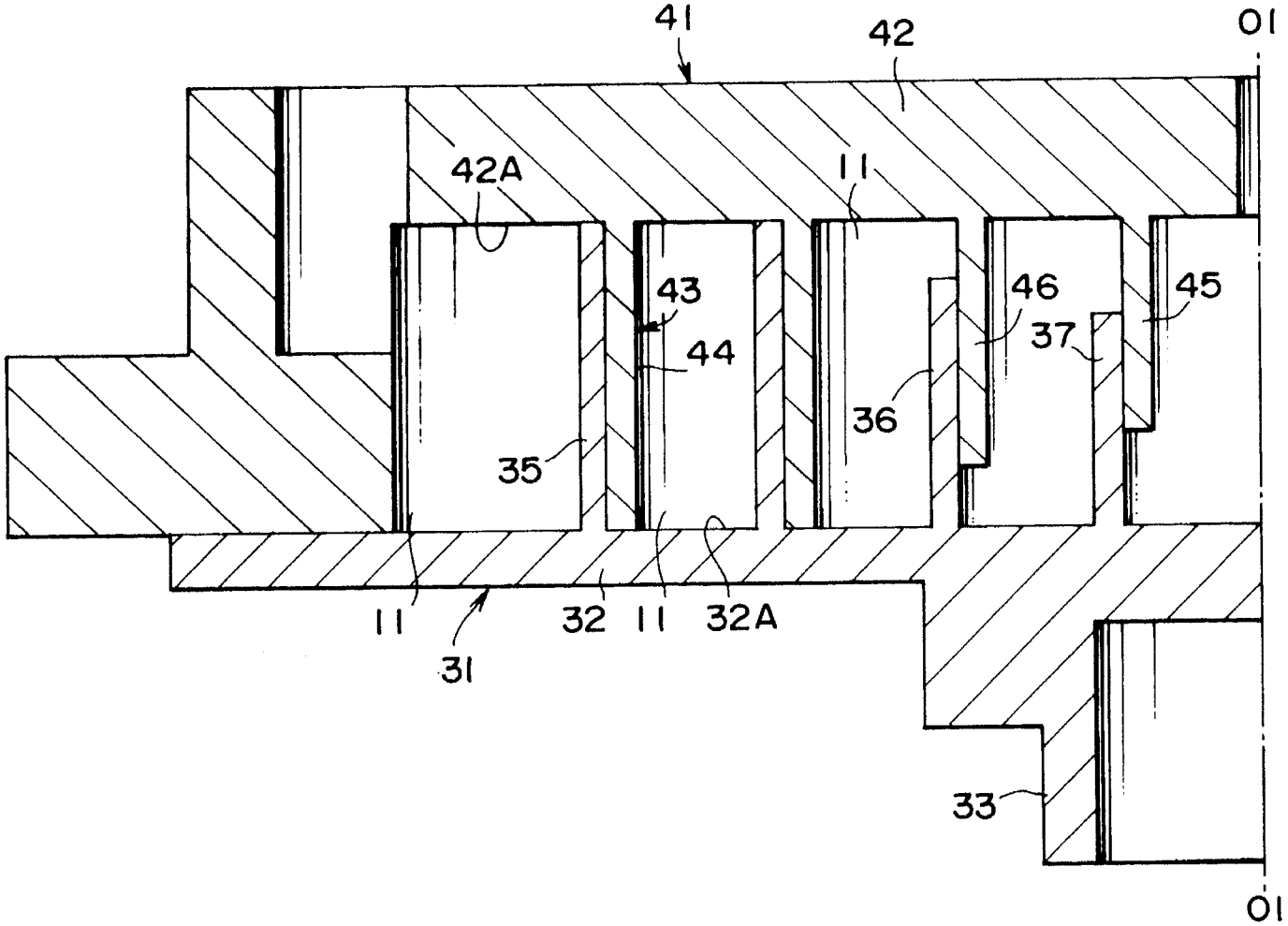
FIG. 7 is an enlarged cross-sectional view of the important part similar to FIG. 5 illustrating another variation.

In addition, as shown in the variation shown in FIG. 7, the fixed scroll component 41 may be combined with the orbitally operating scroll component 31 used in the second embodiment, or with the orbitally operating scroll component 21 used in the first embodiment.

Although the scroll air compressor has been described by using the example of scroll-fluid equipment, this invention is also applicable to, for example, a vacuum pump or a refrigerant compressor.

As described above in detail, according to this invention, at least one of the scroll wrap sections of the rotatably operating or fixed scroll components is formed in such a manner that the axial gap between the scroll wrap section and the bottom of the other scroll component varies at a plurality of levels and that the gap also varies linearly within each section. The axial gap can thus be varied according to an increase in the temperature of the top surface of the scroll wrap section during the compression operation of scroll-fluid equipment without the need to machine the scroll wrap section in the shape of a curve corresponding to its temperature distribution. As a result, the axial gap between the top of the scroll wrap section and the bottom of the other scroll component can be maintained properly even when the scroll wrap section is thermally expanded. That is, without difficult machining of the scroll wrap section, the axial gap between the top of the scroll wrap section and the bottom of the other scroll component can be decreased when the section is thermally expanded. This constitution prevents compressed fluid from leaking and the scroll component from being galled.

In addition, on the one hand, by forming at least the outermost circumferential turn of the scroll wrap section as a flat outer circumferential surface with the greatest height, the flat outer circumferential surface of the outermost circumferential compression chamber is efficiently sealed from the initial operation of scroll-fluid equipment to prevent the gas compressed in this chamber from leaking until the inner portion of the scroll wrap section the top surface of which is inclined is thermally expanded.

On the other hand, since the innermost circumferential turn of the scroll wrap section is formed to have the smallest height and its top surface is flat, galling caused by an increase in frictional force between the scroll wrap section and the bottom of the other scroll component or the sliding movement of the two components is prevented to allow this component to be easily machined.

Furthermore, in the scroll wrap section wherein at least the outermost circumferential turn comprises a flat outer circumferential surface with the greatest height and a first and a second inclined surfaces are formed between the flat outer circumferential surface and the innermost circumferential section so that the height of the scroll wrap section decreases at two levels, the axial gap formed between the first inclined surface and the bottom of the other scroll component and between the second inclined surface and the bottom of the other scroll component provides for thermal expansion due to an increase in the temperature of the scroll wrap section. Different inclinations can thus be provided for the section that may become relatively hot and the section that may not become very hot, thereby allowing the scroll wrap section to be machined easily.

What is claimed is:

1. A scroll-fluid apparatus comprising:

a fixed scroll component having a first end plate and a scroll wrap section installed on said first end plate and projecting therefrom;

an orbital scroll component revolvably provided to face said fixed scroll component and having a second end plate and a scroll wrap section installed on said second end plate and projecting therefrom, to form a plurality of compression chambers between said scroll wrap section of said fixed scroll component and said scroll wrap section of said orbital scroll component;

wherein at least one of said scroll wrap section of said fixed scroll component and said scroll wrap section of said orbital scroll component constitutes a profiled scroll wrap section;

wherein said profiled scroll wrap section comprises an outer section of at least the outermost one turn of said profiled scroll wrap section, an inner section of at least a portion of said innermost turn of said profiled scroll wrap section, and an intermediate section extending between said inner section and said outer section;

wherein said outer section has a constant height along its entire length;

wherein said inner section has a constant height along its entire length, said height of said inner section being less than said height of said outer section; and wherein said intermediate section has a height which continuously linearly decreases from said outer section toward said inner section.

2. A scroll-fluid apparatus as recited in claim 1, wherein said inner section of said profiled scroll wrap section comprises at least the innermost one turn thereof.

3. A scroll-fluid apparatus comprising:

a fixed scroll component having a first end plate and a scroll wrap section installed on said first end plate and projecting therefrom;

an orbital scroll component revolvably provided to face said fixed scroll component and having a second end plate and a scroll wrap section installed on said second end plate and projecting therefrom, to form a plurality of compression chambers between said scroll wrap section of said fixed scroll component and said scroll wrap section of said orbital scroll component;

wherein at least one of said scroll wrap section of said fixed scroll component and said scroll wrap section of said orbital scroll component constitutes a profiled scroll wrap section;

wherein said profiled scroll wrap section comprises an outer section of at least the outermost one turn of said profiled scroll wrap section, and first and second consecutive inclined sections extending between said outer section and an innermost end of said profiled scroll wrap section;

wherein said outer section has a constant height along its entire length;

wherein said first inclined section has a height which continuously linearly decreases from said outer section toward said second inclined section;

wherein said second inclined section has a height which continuously linearly decreases from said first inclined section toward said innermost end of said profiled scroll wrap section; and wherein an angle of inclination of said first inclined section is different than an angle of inclination of said second inclined section, such that said height of said first inclined section decreases toward said second inclined section at a rate different than a rate at which said height of said second inclined section decreases toward said innermost end of said profiled scroll wrap section.

4. A scroll-fluid apparatus as recited in claim 3, wherein said angle of inclination of said second inclined section is greater than said angle of inclination of said first inclined section.

* * * * *